US012516479B2

(12) United States Patent
Friend et al.

(10) Patent No.: US 12,516,479 B2
(45) Date of Patent: Jan. 6, 2026

(54) VARIABLE OVERLAP OPTIMIZED COVERAGE

(71) Applicant: Caterpillar Inc., Peoria, IL (US)

(72) Inventors: Paul Russell Friend, Morton, IL (US); Mark Andrew Tarvin, Canton, IL (US); Nathaniel Steven Doy, Maple Grove, MN (US); Robert Jason McGee, Clayton, NC (US); Joel Case Miller, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 286 days.

(21) Appl. No.: 18/141,161

(22) Filed: Apr. 28, 2023

(65) Prior Publication Data

US 2024/0360633 A1 Oct. 31, 2024

(51) Int. Cl.
*E01C 19/00* (2006.01)
*E01C 19/28* (2006.01)
*E02F 9/20* (2006.01)

(52) U.S. Cl.
CPC ..... *E01C 19/004* (2013.01); *E01C 19/282* (2013.01); *E02F 9/2045* (2013.01)

(58) Field of Classification Search
CPC .... E01C 19/004; E01C 19/282; E02F 9/2045; E02F 9/262
See application file for complete search history.

(56) References Cited

U.S. PATENT DOCUMENTS 6,088,644 A 7/2000 Brandt et al.
7,491,014 B2 2/2009 Sick
7,873,492 B2 1/2011 Ackermann
9,982,397 B2 5/2018 Korb et al.
10,599,153 B2 3/2020 Hoerster et al.
10,640,943 B2 5/2020 Marsolek et al.
11,054,831 B2 7/2021 O'Donnell et al.
(Continued)

FOREIGN PATENT DOCUMENTS

CN 112731917 A 4/2021
DE 102014007783 A1 11/2015
(Continued)

OTHER PUBLICATIONS

Written Opinion and International Search Report for Int'l. Patent Appln. No. PCT/US2024/020612, mailed Jul. 17, 2024 (9 pgs).

*Primary Examiner* — Toya Pettiegrew

(57) ABSTRACT

A control system for a construction machine is disclosed. The control system may comprise a controller configured to: receive work parameters associated with working of the worksite surface by a surface-working member; generate an edge-to-edge work plan of the worksite surface, the edge-to-edge work plan comprising a plurality of paths each having a center-line-of-travel, wherein one of the plurality of paths includes a first outer edge defined by a first boundary side and another includes a second outer edge defined by a second boundary side; and activate the construction machine to traverse the center-line-of travel of each of the plurality of paths. The plurality of paths may comprise a first path and a second path that includes a second path overlap-section that overlaps the first path, wherein a width of the second path overlap-section varies along a length of the second path.

20 Claims, 7 Drawing Sheets

(56) References Cited

U.S. PATENT DOCUMENTS

| | | | | |
|---|---|---|---|---|
| 2014/0324291 | A1* | 10/2014 | Jones | G01S 19/44 701/41 |
| 2015/0167257 | A1* | 6/2015 | Korb | E01C 19/004 404/76 |
| 2020/0034793 | A1 | 1/2020 | Paulsen et al. | |
| 2021/0240193 | A1* | 8/2021 | Endo | E02F 9/205 |
| 2021/0278841 | A1 | 9/2021 | Mcgee et al. | |
| 2022/0412018 | A1 | 12/2022 | Doy | |
| 2023/0220645 | A1* | 7/2023 | Doy | E01C 19/282 404/133.05 |
| 2023/0273615 | A1* | 8/2023 | Liao | G05D 1/0027 701/2 |

FOREIGN PATENT DOCUMENTS

| | | | |
|---|---|---|---|
| JP | 09125700 | A | 5/1997 |
| WO | 2018195766 | A1 | 11/2018 |

* cited by examiner

VARIABLE OVERLAP OPTIMIZED COVERAGE

TECHNICAL FIELD

The present disclosure generally relates to a work machines, and more particularly, to controlling path planning, path overlap and operation of semi-autonomous and/or autonomous paving, construction, mining and forestry work machines.

BACKGROUND

Generally, the parameters used to plan the path to work (e.g., compact) an area include the width of the attachment (e.g., a roller) and the overlap between the paths. For example, compaction machines are frequently employed for compacting soil, gravel, fresh laid asphalt, and other compactable materials associated with worksite surfaces. During construction of roadways, highways, parking lots and the like, one or more compaction machines may be utilized to compact soil, stone, and/or recently laid asphalt. Such compaction machines, which may be semi-autonomous and autonomous machines, travel over the worksite surface whereby the weight of the compaction machine compresses the surface materials to a solidified mass. Additionally, loose asphalt may then be deposited and spread over the worksite surface, and compaction machines may travel over the loose asphalt to produce a densified, rigid asphalt mat. Regardless of the machine, existing path planning systems are not able to plan an area with edge-to-edge worked areas (e.g., compacted areas) without leaving uncompacted gaps or over compacted areas, especially when the areas being worked are irregularly shaped, which causes inefficient run-in and run-out.

U.S. Pat. No. 9,982,397 (the '397 patent) discloses a method for planning and implementation of soil compacting processes using at least one soil compactor. Under the method of the '397 patent, a base region to be compacted is defined, the relevant aspects of a soil compacting process are planned, and the process implemented by moving at least a compactor in the base region, according to the plan. While beneficial, a better system is needed.

SUMMARY OF THE DISCLOSURE

In one aspect of the present disclosure, a control system for a construction machine is disclosed. The construction machine may include a surface-working member configured to work a worksite surface as the construction machine traverses the worksite surface, the worksite surface including a perimeter that includes a plurality of boundary sides. The control system may comprise a controller. The controller may be configured to: receive work parameters associated with working of the worksite surface by the surface-working member, the work parameters comprising a surface-working member width, a minimum overlap distance and a maximum overlap distance: generate an edge-to-edge work plan of the worksite surface, the edge-to-edge work plan comprising a plurality of paths each having a center-line-of-travel, wherein one of the plurality of paths includes a first outer edge defined by a first boundary side and another of the plurality of paths includes a second outer edge defined by a second boundary side; and activate the construction machine to traverse the center-line-of travel of each of the plurality of paths. The plurality of paths may comprise: a first path that includes a first center-line-of-travel; a second path that includes a second center-line-of-travel and a second path overlap-section that overlaps the first path, wherein a width of the second path overlap-section varies along a length of the second path.

In another aspect of the disclosure, a method of controlling a construction machine is disclosed. The construction machine may include a surface-working member configured to work a worksite surface as the construction machine traverses the worksite surface, the worksite surface including a perimeter that includes a plurality of boundary sides. The method may comprise: receiving, by a controller in operable communication with the machine, work parameters associated with working of the worksite surface by the surface-working member, the work parameters comprising a surface-working member width, a minimum overlap distance and a maximum overlap distance: generating an edge-to-edge work plan of the worksite surface, the edge-to-edge work plan comprising a plurality of paths each having a center-line-of-travel, wherein one of the plurality of paths includes a first outer edge defined by a first boundary side and another of the plurality of paths includes a second outer edge defined by a second boundary side; and activating the construction machine to traverse the center-line-of travel of each of the plurality of paths. The plurality of paths may comprise a first path that includes a first center-line-of-travel; and a second path that includes a second center-line-of-travel and a second path overlap-section that overlaps the first path, wherein a width of the second path overlap-section varies along a length of the second path.

In yet another aspect of the disclosure, a control system for a compaction machine is disclosed. The compaction machine may include a roller drum rotationally coupled to the compaction machine and configured to compact a worksite surface as the compaction machine traverses the worksite surface. The roller drum may be further configured to apply vibrational forces to the worksite surface. The worksite surface may include a perimeter that includes a plurality of boundary sides, the plurality of boundary sides including a first boundary side, a second boundary side and remaining boundary sides. The control system may comprise a controller configured to: receive compaction parameters associated with compaction of the worksite surface, the compaction parameters comprising a roller drum width, a minimum overlap distance, a maximum overlap distance, a vibration of the roller drum and/or a maximum vibration amplitude of the roller drum; generate an edge-to-edge compaction plan of the worksite surface, the edge-to-edge compaction plan comprising a plurality of paths each having a center-line-of-travel, wherein one of the plurality of paths includes a first outer edge defined by a first boundary side and another of the plurality of paths includes a second outer edge defined by a second boundary side: activate the compaction machine to traverse the center-line-of travel of each of the plurality of paths; and selectively deactivate vibration of the roller drum, wherein, when the roller drum is disposed on the multi-overlap portion vibration of the roller drum is in a deactivated state. The plurality of paths may comprise a first path that includes a first center-line-of-travel: a second path that includes a second center-line-of-travel and a second path overlap-section that overlaps the first path, wherein a width of the second path overlap-section varies along a length of the second path; and a third path that includes a third-center-line-of-travel and a third path overlap-section that overlaps the second path, wherein the third path overlap-section includes a multi-overlap portion that overlaps the second path overlap-section, wherein a width of the third path overlap-section varies along a length of the third path.

DETAILED DESCRIPTION

Reference will now be made in detail to specific embodiments or features, examples of which are illustrated in the accompanying drawings. Generally, corresponding reference numbers will be used throughout the drawings to refer to the same or corresponding parts, unless otherwise specified.

Figure 1:
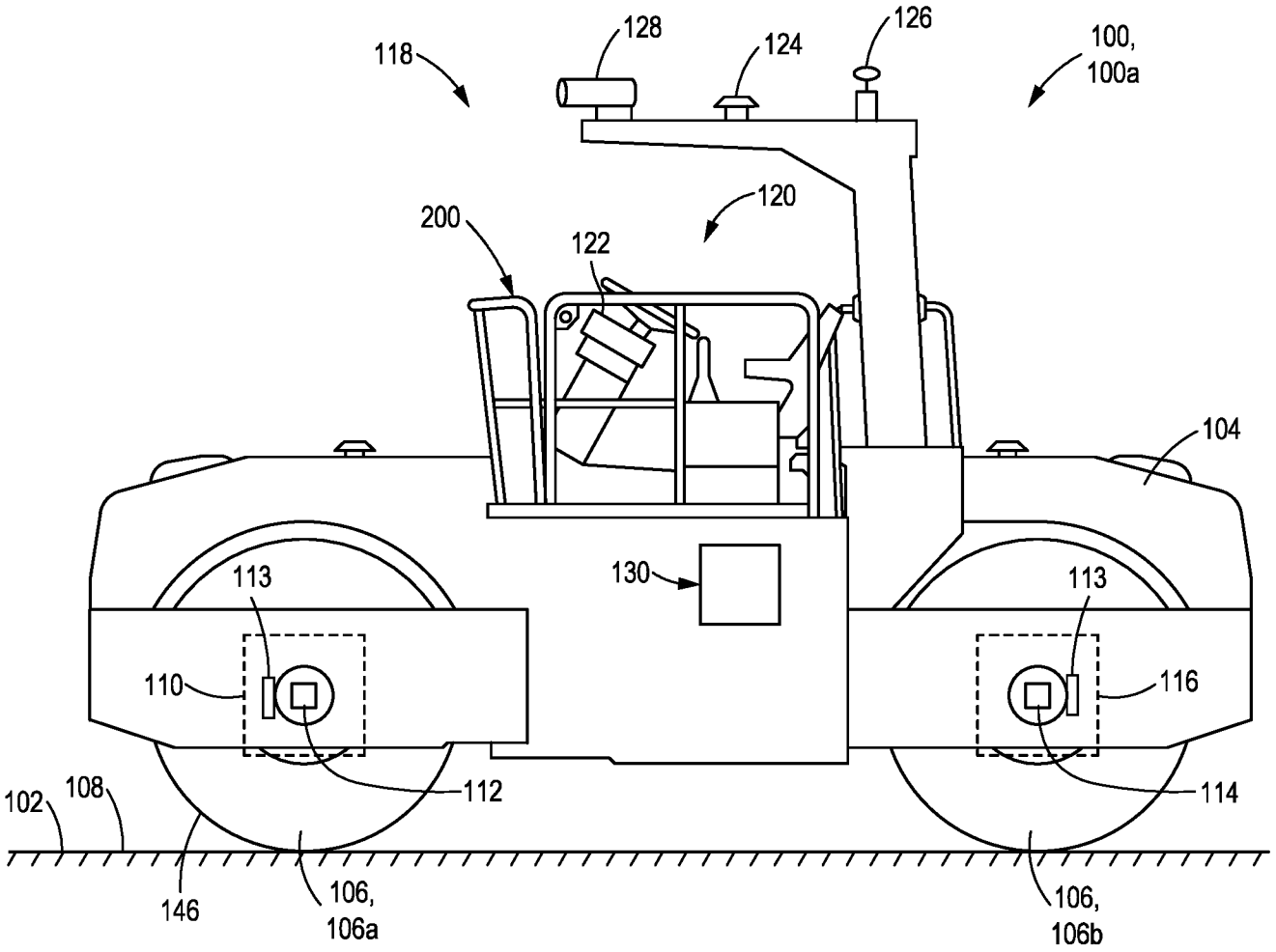
FIG. 1 is a view of one exemplary construction machine that includes a control system according to the present disclosure.

FIG. 1 illustrates an exemplary embodiment of a construction machine 100 that may be controlled with the control system 200 of the present disclosure. The construction machine 100 includes one or more surface-working members 106. In the exemplary embodiment, the construction machine 100 is illustrated as a compaction machine 100*a*. In the exemplary embodiment the surface-working members 106 are first and second roller drums 106*a*, 106*b*. The exemplary compaction machine 100*a* may be used, for example, for road construction, highway construction, parking lot construction, and other such paving and/or construction applications. For example, such a compaction machine 100*a* may be used in situations where it is necessary to compress loose stone, gravel, soil, sand, concrete, and/or other materials of a worksite surface 102 to a state of greater compaction and/or density. As the compaction machine 100*a* traverses the worksite surface 102, vibrational forces generated by the compaction machine 100*a* and imparted to the worksite surface 102, acting in cooperation with the weight of the compaction machine 100*a*, may compress such loose materials. The compaction machine 100*a* may make one or more passes over the worksite surface 102 to provide a desired level of compaction. Although described above as being configured to compact primarily earth-based materials of the worksite surface 102, in other examples, the compaction machine 100*a* may also be configured to compact freshly deposited asphalt or other materials disposed on and/or associated with the worksite surface 102. While the exemplary construction machine 100 described herein is a compaction machine 100*a*, the teachings of this disclosure may be utilized with other construction machines 100 (for example, pavers, dozers or the like) that traverse a worksite surface 102 and such traversals include paths 108 that include overlapping sections.

As shown in FIG. 1, an exemplary compaction machine 100*a* may include a frame 104, and one or more roller drums 106 rotationally coupled the frame 104. In the exemplary embodiment, the compaction machine 100*a* includes a first roller drum 106*a*, and a second roller drum 106*b*. The first and second roller drums 106*a*, 106*b* may each comprise substantially cylindrical drums and/or other compaction elements of the compaction machine 100*a*, and the first and second roller drums 106*a*, 106*b* may each be configured to apply vibration and/or other forces to the worksite surface 102 in order to assist in compacting the worksite surface 102. Although illustrated in FIG. 1 as having a substantially smooth circumference or outer surface, in other examples, the first roller drum 106*a* and/or the second roller drum 108*b* may include one or more teeth, pegs, extensions, bosses, pads, and/or other ground-engaging tools (not shown) extending from the outer surface thereof. Such ground-engaging tools may assist in breaking-up at least some of the materials associated with the worksite surface 102 and/or may otherwise assist in compacting the worksite surface 102. The first roller drum 106*a* and the second roller drum 106*b* may be rotatably coupled to the frame 104 so that the first roller drum 106*a* and the second roller drum 106*b* may roll over the worksite surface 102 as the compaction machine 100*a* traverses the worksite surface 102.

The first roller drum 106*a* may have the same or different construction as the second roller drum 106*b*. In some examples, the first roller drum 106*a* and/or the second roller drum 106*b* may be an elongated, hollow cylinder 146 with a cylindrical drum shell that encloses an interior volume. The first roller drum 106*a* may define a first central axis about which the first roller drum 106*a* may rotate, and similarly, the second roller drum 106*b* may define a second central axis about which the second roller drum 106*b* may rotate. In order to withstand being in rolling contact with and compacting the loose material of the worksite surface 102, the respective drum shells of the first roller drum 106*a* and the second roller drum 106*b* may be made from a thick, rigid material such as cast iron or steel.

The first roller drum 106*a* may include a first vibratory mechanism 110, and the second roller drum 106*b* may include a second vibratory mechanism 116. While FIG. 1 shows the first roller drum 106*a* having a first vibratory mechanism 110 and the second roller drum 106*b* having a second vibratory mechanism 116, in other embodiments only one of the first and second roller drums 106*a*, 106*b* may include a respective vibratory mechanism 110, 116. Such vibratory mechanisms 110, 116 may be disposed inside the interior volume of the first and second roller drums 106*a*, 106*b*, respectively. According to an exemplary embodiment, such vibratory mechanisms 110, 116 may include one or more weights 113 or masses disposed at a position off-center from the respective central axis around which the first and second roller drums 106*a*, 106*b* rotate. As the first and second roller drums 106*a*, 106*b* rotate, the off-center or eccentric positions of the masses are configured to induce oscillatory or vibrational forces to the first and second roller drums 106*a*, 106*b*, and such forces are imparted to the worksite surface 102. The weights 113 are eccentrically positioned with respect to the respective central axis around which the first and second roller drums 106*a*, 106*b* rotate, and such weights 113 are typically movable with respect to each other (e.g., about the respective central axis) to produce varying degrees of imbalance during rotation of the first and second roller drums 106*a*, 106*b*. The amplitude of the vibrations produced by such an arrangement of eccentric rotating weights 113 may be varied by modifying and/or otherwise controlling the position of the eccentric weights 113 with respect to each other, thereby varying the average distribution of mass (i.e., the centroid) with respect to the axis of rotation of the weights 113. Vibration amplitude in such a system increases as the centroid moves away from the axis of rotation of the weights 113 and decreases toward zero as the centroid moves toward the axis of rotation. Varying the rotational speed of the weights 113 about their common axis may change the frequency of the vibrations produced by such an arrangement of rotating eccentric weights 113. In some applications, the eccentrically positioned weights 113 are arranged to rotate inside the first and second roller drums 106*a*, 106*b* independently of the rotation of the first and second roller drums 106*a*, 106*b*. The present disclosure is not limited to these embodiments described above. According to other alternative embodiments, the first and second vibratory mechanisms 110, 116 may be replaced with any other mechanisms that modify the compaction effort of the first roller drum 106*a* or the second roller drum 106*b*. In particular, by altering the distance of the eccentric weights 113 from the axis of rotation, the amplitude portion of the compaction effort is modified. By altering the speed of the eccentric weights 113 around the axis of rotation, the frequency portion of the compaction effort is modified.

With continued reference to FIG. 1, the compaction machine 100 may also include an operator station 118. The operator station 118 may include a steering system 120 including a steering wheel, levers, and/or other controls (not shown) for steering and/or otherwise operating the compaction machine 100*a*. In such examples, the various components of the steering system 120 may be connected to one or more actuators, a throttle of the compaction machine 100*a*, an engine of the compaction machine 100*a*, a braking assembly, and/or other such compaction machine 100*a* components, and the steering system 120 may be used to adjust a speed, travel direction, and/or other aspects of the compaction machine 100*a* during use.

Figure 2:
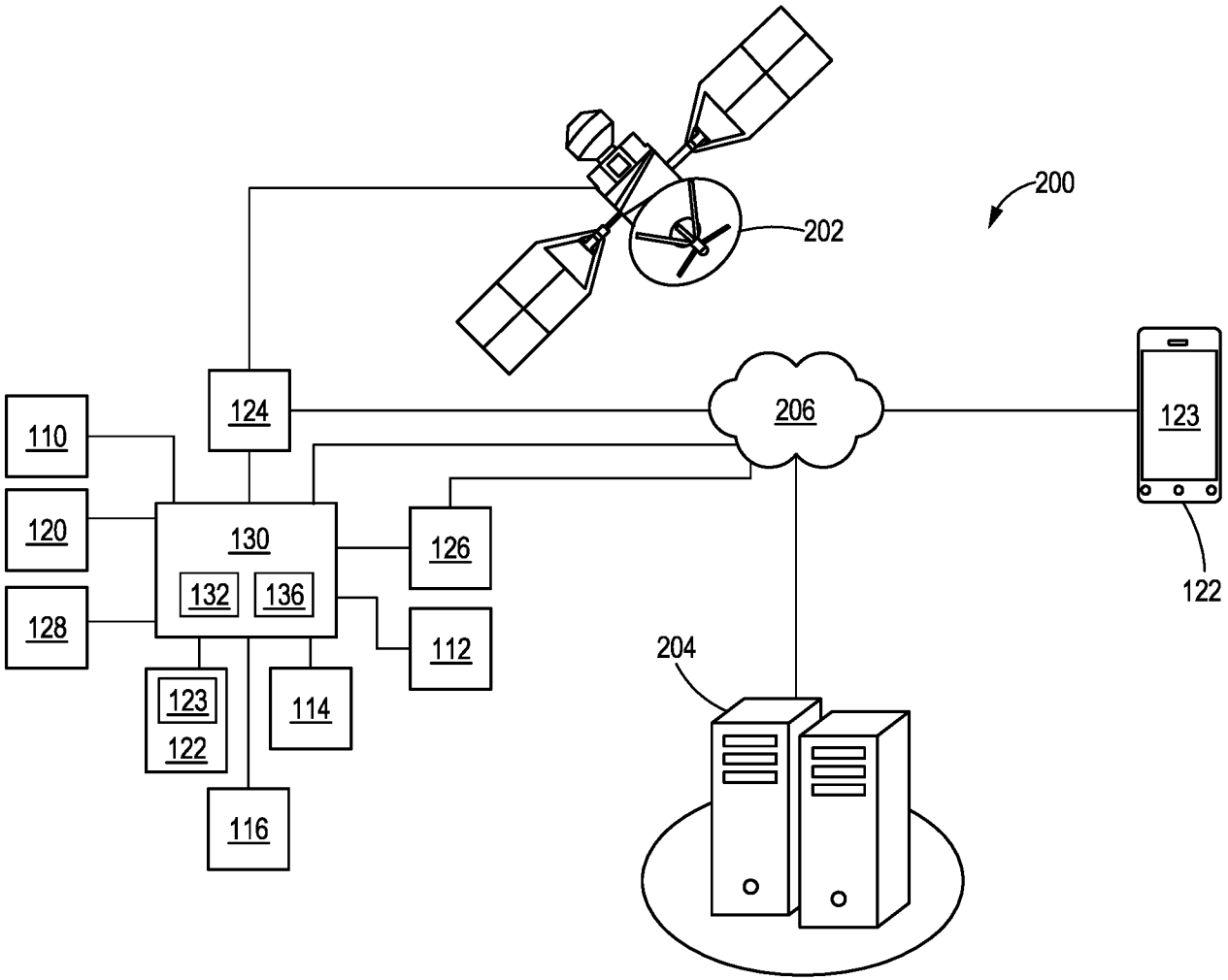
FIG. 2 is a schematic illustration of an exemplary embodiment of the control system according to the present disclosure.

The compaction machine 100*a* further includes the control system 200. FIG. 2 schematically illustrates the exemplary control system 200 of the present disclosure. The control system 200 may be disposed on the compaction machine 100*a* (FIG. 1) and/or remote from the compaction machine 100*a*. The control system 200 (FIG. 2) includes a controller 130. The control system 200 may further include one or more sensors 112, 114, a user interface 122 and a location sensor 124. The control system 200 may further include a communication device 126. The control system 200 may further include a camera 128.

According to an exemplary embodiment, a sensor 112 (FIG. 1) may be located on the first roller drum 106 and/or a sensor 114 may be located on the second roller drum 106*b*. In alternative embodiments, multiple such sensors 112, 114 may be located on the first roller drum 106, the second roller drum 108, the frame 104, and/or other components of the compaction machine 100*a*.

As used herein, work parameters may comprise: (a) operating parameters of the surface-working member(s) 106 (e.g., the first and second roller drums 106*a*, 106*b*) and/or (*b*) characteristics of the worksite surface 102 proximate to the respective surface-working member(s) 106 and/or located along a path 108 of the construction machine 100 on the worksite surface 102, each operating parameter and each characteristic of the worksite surface 102 a work parameter. The operating parameters may include a minimum overlap distance, a maximum overlap distance, number of static passes, the surface-working member width D (e.g., roller drum width, blade width, broom width), and/or a machine propulsion speed, etc.

Figure 8:
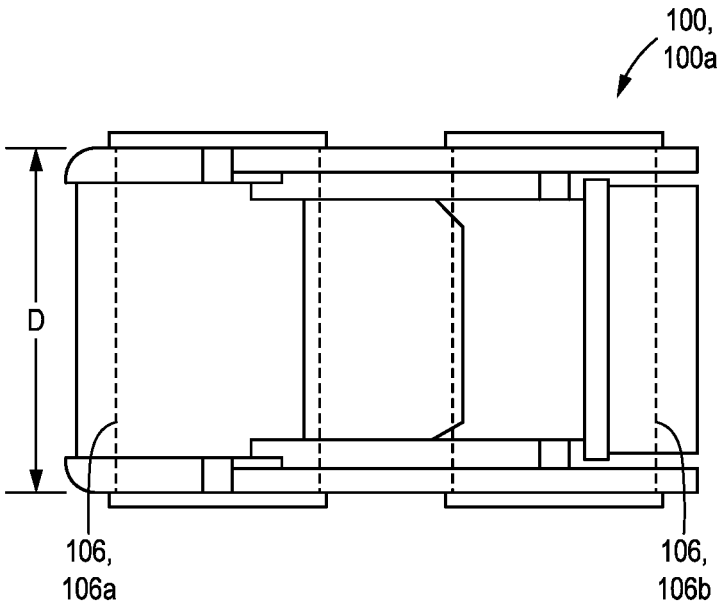
FIG. 8 is a simplified schematic illustrating a top view of the exemplary construction machine of FIG. 1.

When the construction machine 100 is a compaction machine 100*a* and the surface-working member 106 is a roller drum 106*a/b*, the surface-working member width D is the width of the roller drum 106*a/b* and the operating parameters may further include vibration amplitude, vibration frequency, maximum vibration amplitude of the surface-working member 106 (the roller drum 106*a/b*). As used herein, roller drum width D (FIG. 8) refers to the lateral distance between the left and right outermost edges of (roller drum 106) cylinder 146. In an embodiment that utilizes a compaction machine 100*a*, the work parameters may also be referred to as compaction parameters.

Figure 9:
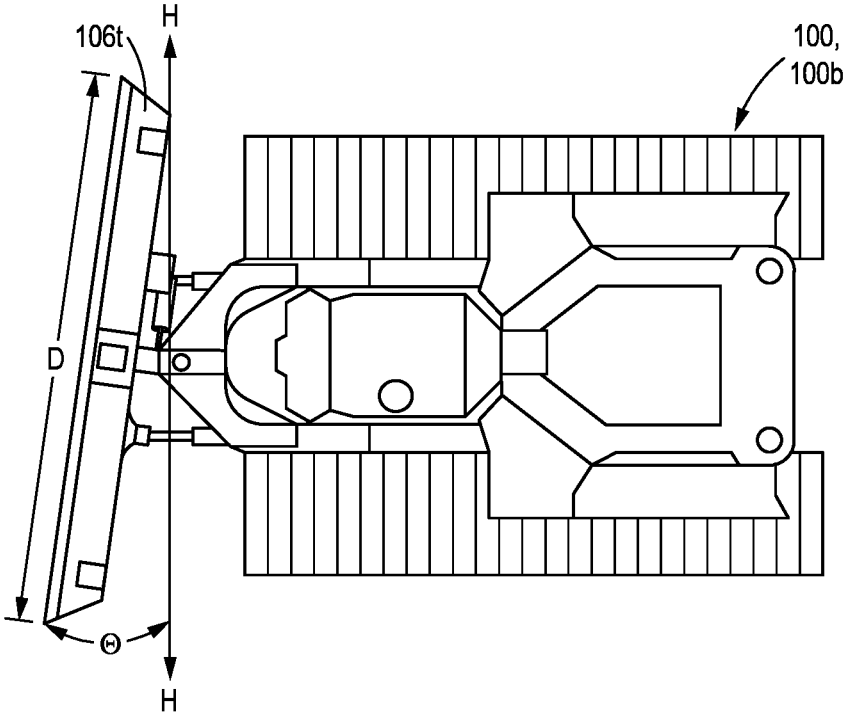
FIG. 9 illustrates a top view of another exemplary construction machine that includes a control system according to the present disclosure.
Figure 10:
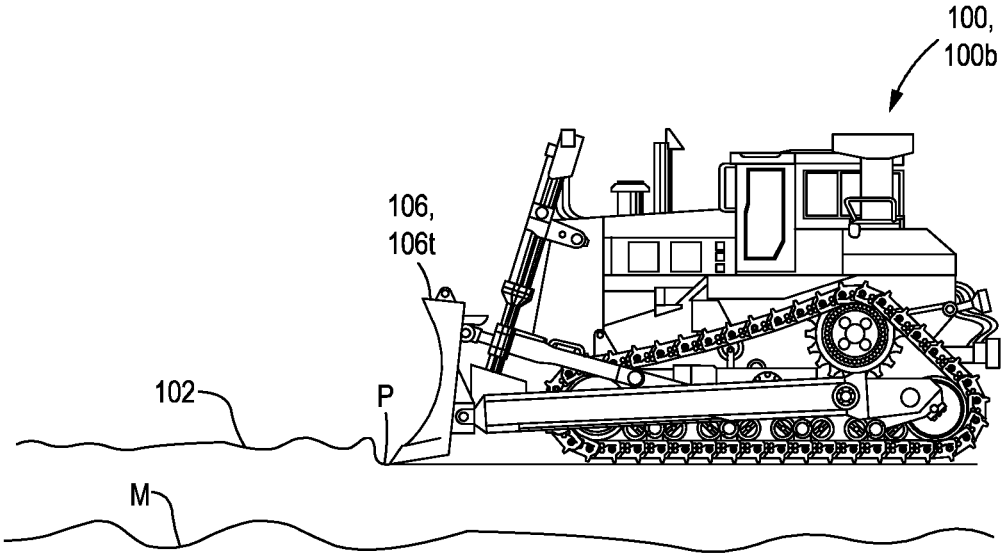
FIG. 10 illustrates a side view of the construction machine of FIG. 9.
Figure 11:
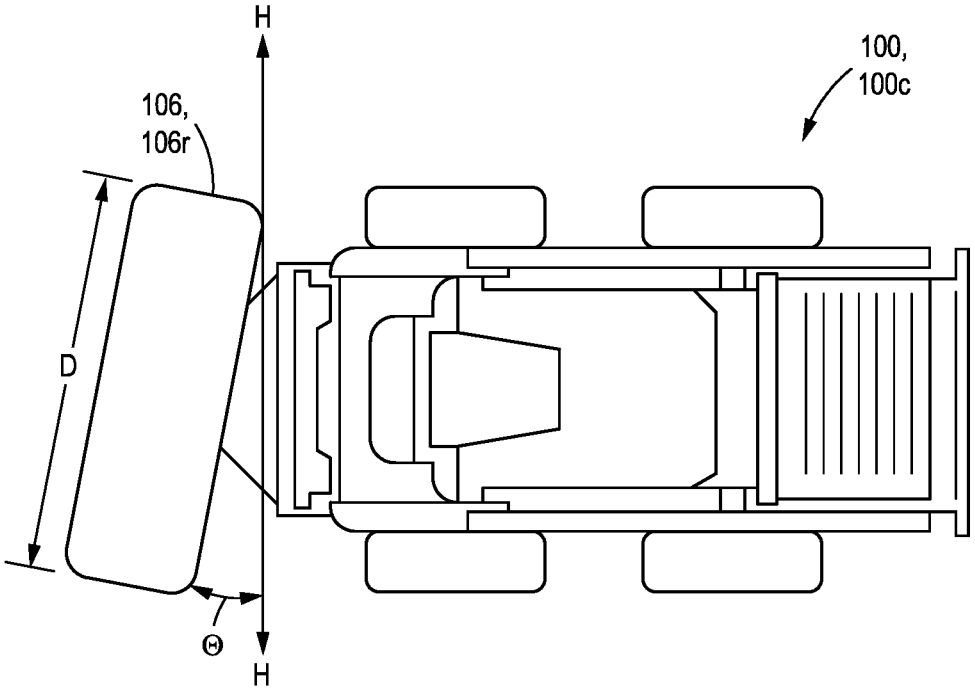
FIG. 11 illustrates a top view of yet another exemplary construction machine that includes a control system according to the present disclosure.

When the construction machine 100 is a track type tractor 100*b* (FIGS. 9-10) or a dozer (not shown) and the surface-working member 106 is a blade 106*t*, the surface-working member width D may be the width of the blade 106*t*, and the operating parameters may further include the blade tilt (angle θ) with respect to a horizontal plane H perpendicular to the direction of travel of the construction machine 100, the blade pitch, the maximum cut depth P per pass (FIG. 10) for the blade 106*t* on the worksite surface 102, and/or an absolute maximum cut depth M for the blade 106*t* as determined based on the target elevation for the worksite surface 102. As is known in the art, the blade pitch controls the angle at which the blade 106*t* is set with respect to the worksite surface 102 when viewing the blade 106*t* from the side.

When the machine 100 is a compact track loader 100*c* (FIG. 10) or skid steer loader (not shown) and the surface-working member 106 is a powered broom 106*r* attachment, the surface-working member width D may be the width of the broom 106*r* and the operating parameters may further include a power status of the broom 106*r* (on/off or high/medium/low/off), and/or a broom tilt (angle θ) measured from a horizontal plane H perpendicular to the direction of travel of the construction machine 100. As used herein, broom width D refers to the longitudinal length of the broom 106*r*.

The minimum overlap distance is the minimum distance (ten centimeters, a hundred centimeters, etc.) that a given path 108 must overlap a directly adjacent path 108, as measured in a direction oriented perpendicular to a center line of travel C of the given path 108. In some embodiments, the minimum overlap distance may be zero. When the minimum overlap distance is set to zero, the directly adjacent paths 108 are edge to edge. The maximum overlap distance (e.g., one meter) is the maximum distance that a given path 108 may overlap a directly adjacent path 108, as measured in a direction oriented perpendicular to a center line of travel C of the given path 108. In some embodiments, wherein the minimum overlap is zero, the maximum overlap distance may also be zero. The maximum overlap distance may be greater than or equal to the minimum overlap distance, and less than or equal to the surface-working member width D (e.g., roller drum width D). As used herein, the term static pass means rolling without vibration. The characteristics of the worksite surface 102 may include density, stiffness, and/or compaction. Any one or more of the work parameters may be retrieved by the controller 130 from a memory component 132.

The user interface 122 is in communication with the controller 130 and is configured to control various functions of the compaction machine 100. The user interface 122 may comprise a display 123. The display 123 may be an analog, digital, and/or touchscreen display. The user interface 122 may be configured to receive and display, for example, at least part of a path 108 (FIGS. 4-7) and/or at least part of an edge-to-edge work plan 107 (e.g., compaction plan) of the present disclosure. The user interface 122 may be configured to receive and display one or more overlap section(s) 142 and/or multi-overlap portion(s) 144. The user interface 122 may be further configured to receive and display information indicative of where vibration is deactivated (e.g. in a multi-overlap portion 144) in the displayed edge-to-edge compaction plan 107 or portion of the displayed edge-to-edge compaction plan 107, and/or where vibration is activated in the displayed edge-to-edge compaction plan 107 or portion of the displayed edge-to-edge compaction plan 107. The user interface 122 may also support other allied functions, including for example, sharing various operating data with one or more other machines (not shown) operating in consonance with the compaction machine 100*a*, and/or with a remote server or other electronic device. The user interface 122 may be disposed on the compaction machine 100*a* or may be disposed remote from the machine 100*a* (e.g. a mobile phone, a tablet, a computer, remote operator station, or the like).

The user interface 122 may be configured to receive and transmit to the controller 130 user input comprising one or more desired work parameters (in the exemplary embodiment, desired compaction parameters) that may include desired operating parameters and/or desired characteristics of the worksite surface 102. The desired operating parameters may include a desired minimum overlap distance, a desired maximum overlap distance, desired number of static passes, and/or desired machine propulsion speed. When the construction machine 100 is a compaction machine 100*a* and the surface-working member 106 is a roller drum 106*a/b*, the desired operating parameters may further include vibration amplitude, vibration frequency and/or maximum vibration amplitude of the surface-working member 106 (the roller drum 106*a/b*). When the construction machine 100 is a track type tractor 100*b* or a dozer and the surface-working member 106 is a blade 106*t*, the desired operating parameters may further include the desired blade tilt (angle θ) with respect to a horizontal plane H perpendicular to the direction of travel of the construction machine 100, the desired blade pitch, the desired maximum cut depth P per pass for the blade 106*t* on the worksite surface 102, and/or an absolute maximum cut depth M for the blade 106*t* as determined based on the target elevation for the worksite surface 102. When the machine 100 is a compact track loader 100*c* or skid steer loader and the surface-working member 106 is a powered broom 106*r* attachment, the desired operating parameters may further include a desired power status of the broom 106*r* (on/off or high/medium/low/off), and/or a desired broom tilt (angle θ) measured from a horizontal plane H perpendicular to the direction of travel of the construction machine 100. The desired characteristics of the worksite surface 102 may include desired density, desired stiffness, and/or desired compaction. Alternatively, the controller 130 may retrieve from the memory component 132 one or more of the desired work parameters. The user interface 122 may also receive as user input and transmit to the controller 130 a travel orientation direction T and a start point.

The sensors 112, 114 may be configured to measure, sense and/or otherwise determine one or more actual work parameters. The sensors 112, 114 are in operable communication with the controller 130 and may be configured to provide one or more actual work parameters to the controller 130. For example, in the exemplary embodiment in which the construction machine 100 is a compaction machine 100*a*, the sensor 112 coupled to the first roller drum 106*a* may be configured to measure, sense, and/or otherwise determine actual operating parameters of the first roller drum 106*a* including actual vibration amplitude of the roller drum 106*a*, actual vibration frequency, actual speed of the eccentric weights 113 of the vibratory mechanism 110 associated with the first roller drum 106*a*, actual distance of such eccentric weights 113 from the axis of rotation, actual speed of rotation of the first roller drum 106*a*, and/or machine propulsion speed etc. Sensor 114 coupled to the second roller drum 106*b* may be configured to measure, sense, and/or otherwise determine actual operating parameters of the second roller drum 106*b* including actual vibration amplitude of the roller drum 106*b*, actual vibration frequency, actual speed of the eccentric weights 113 of the vibratory mechanism 116 associated with the second roller drum 106*b*, actual distance of such eccentric weights 113 from the axis of rotation, machine propulsion speed, and/or actual speed of rotation of the second roller drum 106*b*, etc. When the construction machine 100 is a track type tractor 100*b* or a dozer, and the surface-working member 106 is a blade 106*t*, similar or other sensors may be configured to measure, sense and/or otherwise determine one or more actual work parameters including blade tilt (angle θ), blade pitch, the maximum cut depth P per pass for the blade 106*t* on the worksite surface 102, and/or an absolute maximum cut depth M for the blade 106*t*. When the machine 100 is a compact track loader 100*c* or skid steer loader, and the surface-working member 106 is a powered broom 106*r* attachment, similar or other sensors may be configured to measure, sense and/or otherwise determine one or more actual work parameters including power status of the broom 106*r* (on/off or high/medium/low/off), and/or broom tilt (angle θ).

The sensors 112, 114 may further measure, sense, and/or otherwise determine actual characteristics of the worksite surface 102. Such characteristics of the worksite surface 102 may include actual density, actual stiffness, and/or actual compaction, and may be measured, sensed or determined by the sensors 112, 114 based on the composition, dryness, and/or other characteristics of the material being compacted. Such characteristics of the worksite surface 102 may also be determined based on the actual operating parameters of the surface-working member 106.

The location sensor 124 may be disposed on the compaction machine 100*a*. In one exemplary embodiment, the location sensor 124 may be coupled to the roof of the operator station 118 and/or at one or more other locations on the frame 104. The location sensor 124 may be configured to determine a location of the compaction machine 100*a*, and may comprise one or more components of a Global Navigation Satellite System (GNSS). For example, in one exemplary embodiment, the location sensor 124 may comprise a GNSS receiver, transmitter, transceiver or other such device, and the location sensor 124 may be in communication with one or more GNSS satellites 202 to determine a location of the compaction machine 100*a* continuously, substantially continuously, or at various time intervals, as is known in the art. In other embodiments, other positioning methods may be utilized (e.g., ranging radios, perception based localization, pseudolites, total stations, or the like).

In an embodiment, the location sensor 124 may be configured to determine the location of the compaction machine 100 as the compaction machine 100 traverses a perimeter 136 of the worksite surface 102, the path(s) 108 inside the perimeter 136 of the worksite surface 102 or a perimeter of an avoidance zone (not shown) that may be located substantially within the perimeter 136 of the worksite surface 102. Such an avoidance zone may comprise an area and/or location of the worksite surface 102 that the compaction machine 100*a* may be prohibited from entering during a compaction operation. For example, such an avoidance zone may comprise a trench, ditch, body of water, manhole, electrical connection, wooded area, and/or any other area that may not require compaction.

As shown in FIG. 2, the location sensor 124 may be in operable communication with one or more satellites 202 or other GNSS components configured to assist the location sensor 124 in determining the location of the compaction machine 100. In some embodiments, the control system 200 may also comprise such satellites 202 or other GNSS components. In any of the examples described herein, the location sensor 124 either alone or in combination with the satellite 202 may be configured to provide the controller 130 with signals including information indicative of a location of the perimeter 136 of the worksite surface 102, a location of the perimeter of an avoidance zone, the location of the compaction machine 100, and/or other information. Such information may include GNSS coordinates of each point along such perimeters and/or of each point along a path 108 of the compaction machine 100. Such information may be determined substantially continuously during movement of the compaction machine 100. Alternatively, such information may be determined at regular time intervals (milliseconds, one second, two seconds, five seconds, ten seconds, etc.) as the compaction machine 100*a* travels. Further, any such information may be stored in a memory component 132 associated with the controller 130 and retrieved therefrom by the controller 130. Such memory component 132 may be disposed on the compaction machine 100*a* and/or may be located in the cloud, on a server, and/or on any other electronic device located remote from the compaction machine 100. It is understood that in some embodiments information indicative of the location of the perimeter 136 of the worksite surface 102, the location of the perimeter of an avoidance zone, and/or other information may be pre-loaded within the memory component 132 and may be obtained from one or more professional surveys, topographical maps, and/or other prior analysis of the worksite surface 102. In such embodiments, it may not be necessary to traverse the perimeter 136 of the worksite surface 102 and/or the perimeter of the avoidance zone in order to determine such information.

The communication device 126 is in operable communication with the controller 130 and may be configured to enable the controller 130 to communicate via a network 206 with the one or more other machines, and/or with one or more computing devices 204 (e.g., servers, processors or systems) or user interfaces 122 located at the worksite and/or located remote from the worksite at which the compaction machine 100*a* is being used. In one embodiment, the communication device 126 may include a receiver/transmitter configured to receive/transmit various electronic signals including location data, navigation commands, real-time information, project-specific information, actual/desired work parameters and/or other data.

A camera 128 may be disposed on the compaction machine 100*a* or remote from the compaction machine 100*a*. In some embodiments, the camera 128 may comprise a digital camera configured to record and/or transmit digital video of the worksite surface 102 and/or other portions of the worksite 102 in real-time to the controller 130. In other embodiments, the camera 128 may comprise an infrared sensor, a thermal camera, or other like device configured to record and/or transmit thermal images of the worksite surface 102 in real-time. In some examples, the compaction machine 100 may include more than one camera 128 (e.g., a camera 128 at the front of the compaction machine 100*a* and a camera 128 at the rear of the compaction machine 100*a*).

The controller 130 may be in operable communication with the sensors 112, 114, the vibratory mechanism 110, 116, the steering system 120, the user interface 122, the location sensor 124, the communication device 126, the camera 128, computing devices 204 and/or other components of the compaction machine 100*a*.

The controller 130 may be configured to receive/retrieve one or more desired work parameters (e.g., desired compaction parameters) from the user interface 122 and/or memory component 132 and to receive/retrieve one or more actual work parameters from the sensors 112, 114 or the like and/or memory component 132 (e.g., surface-working member width D).

The controller 130 may be configured to receive the location of the compaction machine 100*a*. For example, the controller 130 may be configured to receive the location of the compaction machine 100 as the compaction machine 100 traverses a perimeter 136 of the worksite surface 102, the path(s) 108 inside the perimeter 136 of the worksite surface 102 or a perimeter of an avoidance zone (not shown) that may be located substantially within the perimeter 136 of the worksite surface 102.

The controller 130 may receive activated electronic boundaries E or determine such boundaries from information received from the user interface 122, the memory component 132, or other computing devices. The controller 130 may be configured to receive the location of the compaction machine 100*a* outside of the worksite surface 102 and determine whether the compaction machine 100*a* is within the electronic boundaries.

The controller 130 may be configured to receive from the camera 128 digital video of the worksite surface 102 and/or other portions of the worksite 102 in real-time to the controller 130.

The controller 130 may include a processor 134 and a memory component 132. The processor 134 may be a microcontroller, a digital signal processor (DSP), an electronic control module (ECM), an electronic control unit (ECU), a microprocessor or any other suitable processor 134 as known in the art. The processor 134 may execute instructions and generate control signals for determining a work area of the worksite surface 102, a start point, travel direction orientation T, maximum width Wmax of the worksite surface 102 and the quantity of paths 108, and center-line-of-travel C and for generating an edge-to-edge work plan 107 (e.g., compaction plan) and activating the construction machine 100 to traverse the worksite 102, according to the edge-to-edge work plan 107 (e.g., compaction plan). Such instructions may be read into or incorporated into a computer readable medium, such as the memory component 132 or provided external to the processor 134. In alternative embodiments, hard wired circuitry may be used in place of, or in combination with, software instructions to implement a control method.

The controller 130 may be configured to transmit steering instructions for autonomous/semi-autonomous control of the construction machine 100, braking instructions for autonomous/semi-autonomous control of the construction machine 100, and/or other operating parameters of the construction machine 100 (e.g., compaction machine 100*a*.) When the construction machine 100 is a compaction machine 100*a* and the surface-working member 106 is a roller drum 106*a/b*, the controller 130 may be configured to control the vibratory mechanisms 110, 116 to modify at least one of a vibration frequency of the respective first and/or second roller drum(s) 106*a*, 106*b* and a vibration amplitude of the respective first and second roller drums 106*a*, 106*b*, as the compaction machine 100*a* traverses the path 108, based at least partly on desired or actual work parameters. The controller 130 may be configured to selectively deactivate and/or activate the vibratory mechanisms 110, 116. More specifically, the controller 130 is configured to selectively deactivate vibration (of the vibratory mechanisms 110, 116) of the roller drum(s) 106, wherein the vibration is deactivated in multi-overlap portions 144 and to selectively (re) activate vibration (of the vibratory mechanisms 110, 116) of the roller drum(s) 106. In an embodiment, the controller 130 may be further configured to gradually decrease to "no vibration" the vibration (of the vibratory mechanisms 110, 116) of the roller drum 106 before or upon entering the multi-overlap portion 144 and to activate vibration (of the vibratory mechanisms 110, 116) of the roller drum 106 and gradually increase the vibration of the roller drum 106 before or upon exiting multi-overlap portion 144. In some embodiments, the controller 130 may ramp vibration down/up before the compaction machine 100*a* is enters/leaves the multi-overlap portions 144 for gradual transition. When the construction machine 100 is a track type tractor 100*b* or a dozer and the surface-working member 106 is a blade 106*t*, the controller 130 may be configured to modify the blade tilt, the blade pitch, the maximum cut depth P per pass for the blade 106*t* on the worksite surface 102, and/or the maximum cut depth M for the blade 106*t*. When the machine 100 is a compact track loader 100*c* or skid steer loader and the surface-working member 106 is a powered broom 106*r* attachment, the controller 130 may be configured to modify the power status of the broom 106*r* (on/off or high/medium/low/off), and/or the broom tilt.

The term "computer readable medium" as used herein refers to any non-transitory medium or combination of media that participates in providing instructions to the processor 134 for execution. Such a medium may comprise all computer readable media except for a transitory, propagating signal. Common forms of computer-readable media include, for example, flash memory, EEPROM, floppy disk, a flexible disk, hard disk, magnetic tape, or any other magnetic medium, a CD-ROM, any other optical medium, or any other computer readable medium.

The controller 130 is not limited to one processor 134 and memory component 132. The controller 130 may include several processors 134 and memory components 132. In an embodiment, the processors 134 may be parallel processors that have access to a shared memory component(s) 132. In another embodiment, the processors 134 may be part of a distributed computing system in which a processor 134 (and its associated memory component 132) may be located remotely from one or more other processor(s) 134 (and associated memory components 132) that are part of the distributed computing system. The controller 130 may also be configured to retrieve from the memory component 132 data necessary for the actions discussed herein.

Also disclosed is a method of controlling a construction machine 100 that includes a surface-working member 106 configured to work a worksite surface 102 as the construction machine 100 traverses the worksite surface 102, the worksite surface 102 including a perimeter 136 that includes a plurality of boundary sides 138. The method may comprise receiving, by a controller 130 in operable communication with the construction machine 100, work parameters associated with working of the worksite surface 102 by the surface-working member 106, the work parameters comprising a surface-working member width D, a minimum overlap distance and a maximum overlap distance. The method may further comprise generating an edge-to-edge work plan 107 of the worksite surface 102, the edge-to-edge work plan 107 comprising a plurality of paths 108 each having a center-line-of-travel C, wherein one of the plurality of paths 108 includes a first outer edge 140*a* defined by a first boundary side 138*a* and another of the plurality of paths 108 includes a second outer edge 140*b* defined by a second boundary side 138*b*. The plurality of paths 108 may comprise a first path 108 that includes a first center-line-of-travel C; a second path 108 that includes a second center-line-of-travel C and a second path overlap-section 142 that overlaps the first path 108, wherein a width of the second path overlap-section 142 varies along a length of the second path 108; and a third path 108 that includes a third center-line-of-travel C and a third path overlap-section 142 that overlaps the second path 108, wherein the third path overlap-section 142 includes a multi-overlap portion 144 that overlaps the second path overlap section 142, wherein a width of the third path overlap-section 142 varies along a length of the third path 108. The method may further comprise activating the construction machine 100*a* to traverse the center-line-of travel C of each of the plurality of paths 108.

INDUSTRIAL APPLICABILITY

Figure 3:
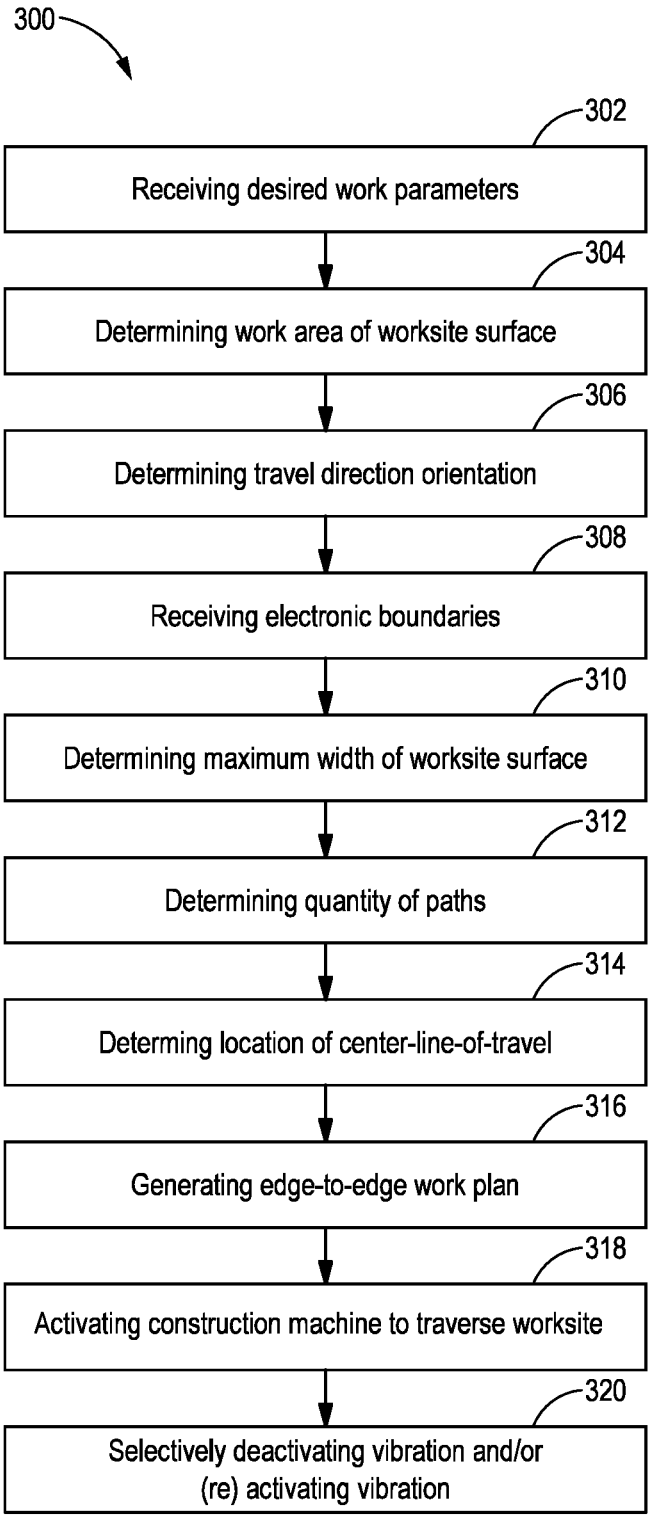
FIG. 3 is a flow diagram of one exemplary method of controlling the construction machine in accordance with an embodiment of the present disclosure.

In FIG. 3 an exemplary flowchart is illustrated showing sample blocks which may be followed in a method 300 of controlling the construction machine 100, which includes a surface-working member 106, using the control system 200. For the purposes of illustration, the construction machine 100 is a compaction machine 100*a*, the surface working member 106 is a roller drum 106*a* and the edge-to-edge work plan 107 generated is an edge-to-edge compaction plan 107. In other embodiments, a construction machine 100 other than a compaction machine 100*a* may be used and the edge-to-edge work plan 107 may be other than an edge-to-edge compaction plan. The order of the blocks of the exemplary flowchart is not intended to be construed as a limitation unless expressly indicated, and any number of the described blocks may be combined in any order and/or in parallel to implement the method 300.

Block 302 includes receiving, by the controller 130, one or more desired work parameters associated with working of the worksite surface 102 by the surface-working member 106. In the exemplary embodiment, the worksite surface 102 is a shape other than a rectangle. Because the construction machine 100 in this exemplary embodiment is a compaction machine 100*a*, the desired work parameters are desired compaction parameters associated with compacting the worksite surface 102 by the roller drum(s) 106. The desired compaction parameters may comprise a roller drum width D, a minimum overlap distance and a maximum overlap distance, one or more desired vibration amplitude settings of the roller drum 106, a maximum vibration amplitude of the roller drum 106, and/or a desired number of static passes. The desired compaction parameters may further include desired stiffness, desired density, and/or desired compaction of the worksite surface 102, and/or other requirements.

Such desired compaction parameters may be received by the controller 130 at block 302 via the user interface 122, and/or one or more servers, processors, computing devices 204, and/or other components of the control system 200. In some embodiments, such desired compaction parameters may be pre-loaded within a memory component 132 in communication with the controller 130, and received by the controller 130 from such memory component 132. In other embodiments, the compaction parameters may be otherwise received by the controller 130.

Figure 4:
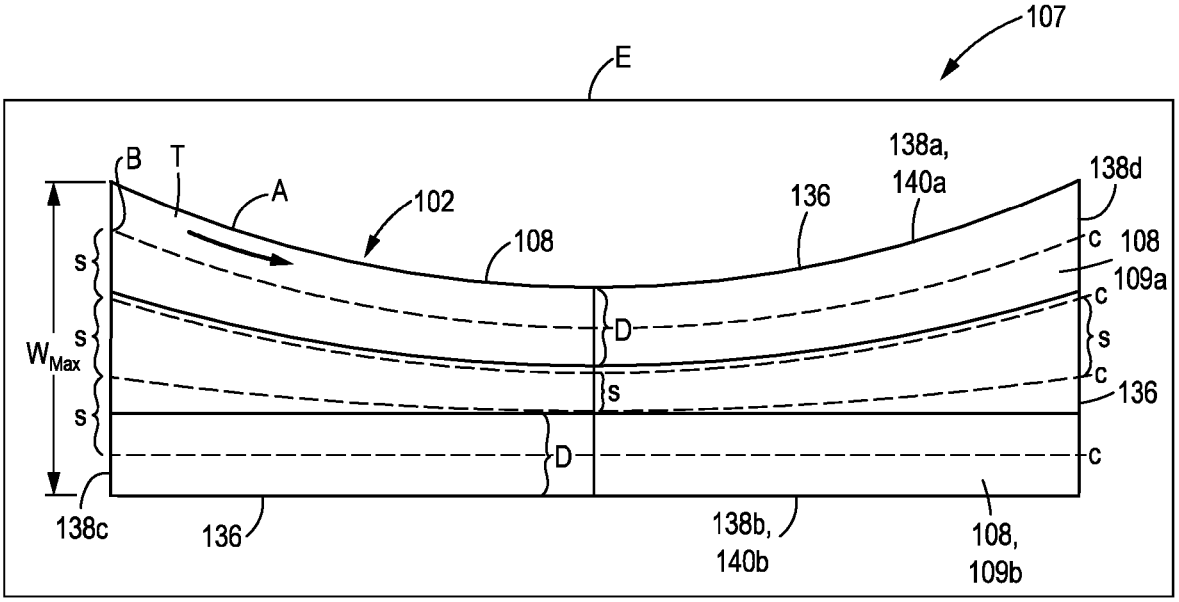
FIG. 4 is a schematic illustration of an exemplary worksite surface 102 and portion of an edge-to-edge compaction plan, according to the present disclosure.

Block 304 includes determining the work area A of the worksite surface 102 (e.g., the compaction area defined by the perimeter 136 of the worksite surface 102 less any avoidance zones internal to the perimeter 136). The work area A of the worksite surface 102 may be defined utilizing various methods known in the art. For example, in one embodiment, the compaction machine 100*a* may be utilized to set the work area perimeter 136 (boundary) and set any boundaries of avoidance zones. In such a scenario, the controller 130 may receive information from at least one of the sensors 114, 116, 124 of the compaction machine 100*a*, and/or memory component 132, and/or may receive information from one or more remote servers, processors, computing devices 204, electronic devices 208, and/or other components of the control system 200 to determine the work area A perimeter 136 boundary and/or boundaries of the avoidance zones. For example, the location sensor 124 and/or other components of the control system 200 may determine a location of the compaction machine 100*a* on the worksite surface 102 substantially continuously or at predetermined intervals of time (e.g., every millisecond, every second, every two seconds, every five seconds, etc.). In such an example, the location sensor 124 and/or other components of the control system 200 may be configured to generate one or more signals including information indicative of the location of the compaction machine 100*a*, and may provide such signals to the controller 130. Accordingly, the controller 130 may receive one or more signals from the location sensor 124 and/or other components of the control system 200, and such signals may include GNSS coordinates (e.g., latitude and longitude coordinates), map information, and/or other information determined by the location sensor 124 and indicating the location of the compaction machine 100*a*. Such signals may also include timestamp information indicating the moment in time (e.g., hour, minute, second, millisecond, etc.) at which the location information or other information included in the signal was determined. An operator may drive the compaction machine 100*a* along the perimeter 136 of the worksite surface 102. Such an example worksite surface 102 is illustrated in FIG. 4. In some embodiments, the worksite surface 102 may also include one or more avoidance zones (not shown) as described above. The controller 130 may receive information indicative of the location of the perimeter 136 of the worksite surface 102 from the location sensor 124 based at least partly on the compaction machine 100 traversing the perimeter 136 of the worksite surface 102. In such examples, the operator may drive the compaction machine 100*a* along a perimeter 136 of the worksite surface 102 from an operator station 118 located on the compaction machine 100*a* or, alternatively, from a remote location through the use of a remote user interface 122 that is in communication with the compaction machine 100*a*.

While not shown in FIG. 4, if the worksite surface 102 includes an avoidance zone, the operator may drive the compaction machine 100*a* along the perimeter of the avoidance zone. As noted above with respect to the perimeter 136 of the worksite surface 102, the location sensor 124 and/or other components of the control system 200 may determine a location of the compaction machine 100*a* as the compaction machine 100*a* traverses the perimeter of the avoidance zone, and the location sensor 124 and/or other components of the control system 200 may generate one or more signals including information indicative of the location of the perimeter of the avoidance zone, and may provide such signals to the controller 130. Accordingly, the controller 130 may receive one or more signals from the location sensor 124 and/or other components of the control system 200, and such signals may include GNSS coordinates (e.g., latitude and longitude coordinates), map information, and/or other information determined by the location sensor 124 and indicating the location of the perimeter of the avoidance zone. Such signals may also include timestamp information indicating the moment in time (e.g., hour, minute, second, millisecond, etc.) at which the location information or other information included in the signal was determined.

Additionally or alternatively, information indicative of the location of the perimeter 136 of the worksite surface 102 and/or the perimeter of the avoidance zone may be obtained from one or more professional surveys, topographical maps, and/or other prior analysis of the worksite surface 102, and such information may be pre-loaded within a memory component 132 in communication with the controller 130. For example, a prior analysis of the worksite 102 may be generated from position and location data collected by another machine that performs preparatory work on the worksite surface 102 prior to compaction, such as a motor grader or rotary mixer. In these examples, the perimeter 136 of the worksite surface 102 and/or the perimeter of the avoidance zone may be calculated or otherwise determined from the path taken by the preparatory machine. In any of the above examples, such information may be obtained from the memory component 132 and/or otherwise received by the controller 130.

Block 306 includes determining, by the controller 130, a start point B and the travel direction orientation T for the compaction machine 100*a* across the worksite surface 102 based on a length of a boundary side 138 of the perimeter 136, a slope of the worksite surface 102, or a user input received from the user interface 122 in communication with controller 130. The perimeter 136 of the worksite surface 102 may include a plurality of boundary sides 138. In one embodiment, the travel direction orientation T may be determined based on length of a boundary side 138, or based on the longest boundary side 138 of the perimeter 136 of the worksite surface 102. In the embodiment of FIG. 4, the first boundary side 138*a* and the second boundary side 138*b* are the same length and either could be considered the longest boundary side 138 when compared to the other remaining boundary sides 138 (*c*-*d*) (those that are not the first/second boundary sides 138 (*a*-*b*)) of the plurality of boundary sides 138 that make up the perimeter 136. In such a case, the travel direction orientation T of the compaction machine 100*a* across the worksite surface 102 may be determined by the controller 130 based on the longest boundary side 138 that is either of the first boundary side 138*a* or the second boundary side 138*b*. As shown in FIG. 4, the travel direction orientation T is not meant to imply that all passes must go from left to right on the exemplary worksite surface 102, but instead that the passes (in this embodiment) are side to side instead of up and down in FIG. 4. In other embodiments, the travel direction orientation T may be determined based on topography slope of the worksite surface 102, which may be based on one or more professional surveys, topographical maps, and/or other analysis of the worksite surface 102. In other embodiments, travel direction orientation T may be retrieved by the controller 130 from a memory component 132 in communication with the controller 130 or received from a user interface 122. For example, as part of block 306, the controller 130 may display on the user interface 122 the determined travel direction orientation T and start point B. A user, or the like, may override the determined travel direction orientation T and/or start point by inputting a desired start point B or a desired travel direction orientation T into the user interface 122 that is in communication with the controller 130.

Block 308, the controller 130 may receive activated electronic boundaries E, if any, to keep the compaction machine 100*a* within a defined area. An electronic boundary E for a portion of the defined area may be the same as a portion of the perimeter 136 of the worksite surface 102 or the electronic boundary(ies) E may each be set off a buffer distance from the perimeter 136 of the worksite surface 102 (as shown in FIG. 4). Such activated electronic boundaries E may be received from a user via the user interface 122 or may be determined automatically by the controller 130 based on a default buffer distance, a calculated buffer distance or a buffer distance input by user into the user interface 122. In any of the above examples, such information may be obtained from the memory component 132 and/or otherwise received by the controller 130. Determination of such electronic boundaries E is known in the art, and will not be discussed further herein. The controller 130 utilizes data received from the sensors 114, 116, 124 to automatically stop the compaction machine 100*a* from traveling outside of the electronic boundaries E.

Block 310 includes determining, by the controller 130, the maximum width (Wmax) of the worksite surface 102 based on the travel direction orientation T. The maximum Wmax width is that portion of the worksite surface 102 having the longest diameter extending, in a direction transverse to the travel direction orientation T. For example, as can be seen in FIG. 4, the maximum width Wmax of the worksite surface 102 having the longest diameter extends in a direction transverse to the travel direction orientation T. In the embodiment in FIG. 4, the right and left boundary sides 138 (*a, b*) are of the same length and thus the length of either may be the maximum width Wmax.

Block 312 includes determining, by the controller 130, the quantity of paths P required for the edge-to-edge work plan 107 (in this case the edge-to-edge compaction plan 107). As used herein, the term "edge-to-edge" in the context of a work plan or a compaction plan means that the work/compaction plan provides full coverage of the worksite surface 102 (excluding avoidance zones). The edge-to-edge compaction plan 107 comprises a plurality of paths 108 oriented across the worksite surface 102. FIG. 4 illustrates two exemplary paths 108 in the present example.

Each of the plurality of paths 108 has a center-line-of travel C. In FIG. 4 there are four paths 108 in total. The center-line-of travel C of each is illustrated in FIG. 4. The center-line-of-travel C is the "line" on which the compaction machine 100*a* is centered as it traverses the worksite surface 102. One of the plurality of paths 108 includes a first outer edge 140*a* defined by a first boundary side 138*a* of the worksite surface 102 and another of the plurality of paths 108 includes a second outer edge 140*b* defined by a second boundary side 138*b*, wherein at least one or both of the first and second boundary sides 138*a*, 138*b* is/are longer than the remaining boundary sides 138*c*, 138*d* of the plurality of boundary sides 138 that make up the perimeter 136. In an embodiment, the second boundary side 138*b* may be disposed opposite the first boundary side 138*a*.

Figure 5:
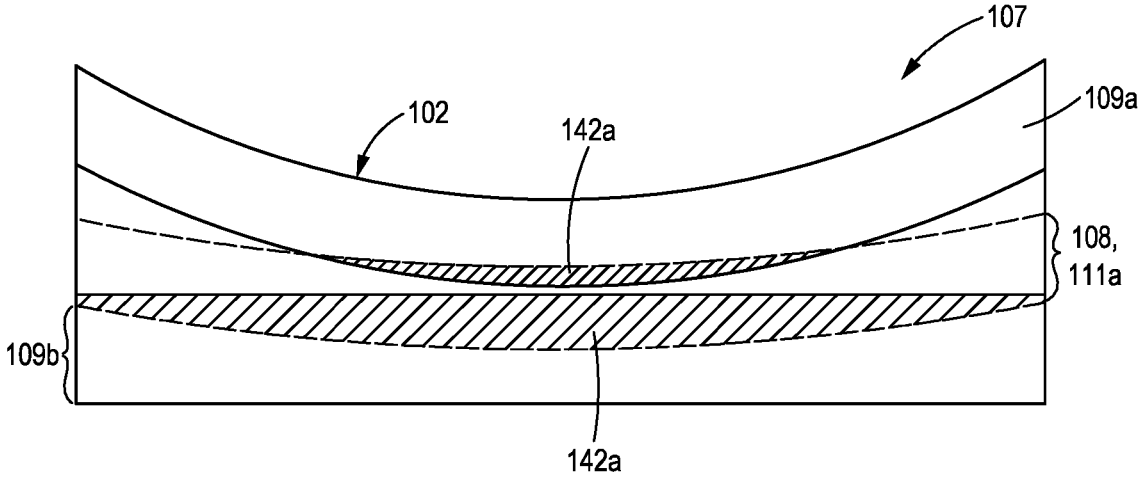
FIG. 5 is a schematic illustration of a portion of an edge-to-edge-compaction plan, according to an exemplary embodiment of the present disclosure.
Figure 6:
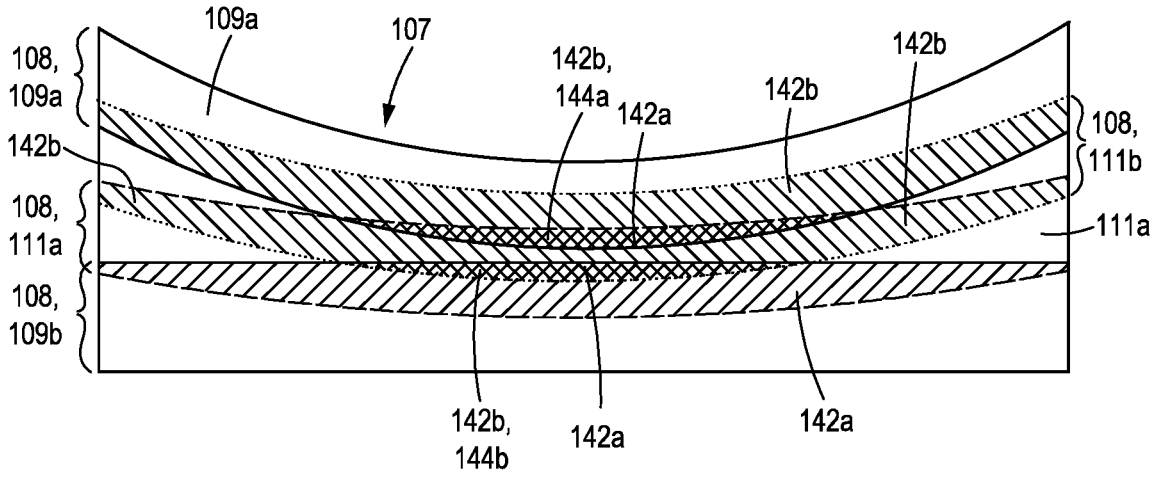
FIG. 6 is a schematic illustration of multi-overlap portions on a worksite surface.

In FIG. 4, the one of the plurality of paths 108 that includes the first outer edge 140*a* defined by the first boundary side 138*a* is a first boundary path 109*a* and the other of the plurality of paths 108 that includes the second outer edge 140*b* defined by the second boundary side 138*b* is a second boundary path 109*b*. The center-line-of-travel C for the first boundary path 109*a* is disposed half of the roller drum width D from first boundary side 138*a* and the center-line-of-travel C for the second boundary path 109*b* is disposed half of the roller drum width D from second boundary side 138*b*. Each of the plurality of paths 108 disposed between the first boundary path 109*a* and the second boundary path 109*b* are internal paths 111 (as best seen in FIGS. 5-6). Due to the complexity of the showing the first and second boundary paths 109 (*a, b*) and the internal paths 111 in the same figure, only the center-line-of-travel C for each internal path are shown in FIG. 4 and reference should be made to FIGS. 5-6 to visualize the internal paths 111*a* and 111*b*. The figures are illustrative only and are not drawn to scale.

In one embodiment, the controller 130 may determine the quantity P of paths 108 utilizing the following equation 1. In other embodiments, other equations/methodology may be used.

$$P = \left((W\max - L)/(D - L)\right) \quad \text{[Equation 1]}$$

wherein

P is rounded up to the nearest whole number,

Wmax=the maximum width of the worksite surface 102,

L=the minimum overlap distance

D=the surface-working member width (for example, roller drum width).

Block 314 includes determining, by the controller 130, a location of each center-line-of-travel C of each of the internal paths 111, wherein the location of the center-lines-of-travel C of adjacent internal paths 111 are offset by a distance S (see FIGS. 4-6, FIG. 4 illustrates the center-lines-of travel of all paths, FIG. 5 illustrates one internal path 111, and FIG. 6 illustrates both internal paths 111), and the center-line-of-travel C of the internal path 111 adjacent to each boundary path 109 is offset S from the center-line-of-travel C of the adjacent boundary path 109. In an embodiment, S may be determined by Equation 2:

$$S = (W - D)/(P - 1) \quad \text{[Equation 2]}$$

wherein

W=a width of the worksite area 102, the width transverse to the travel direction orientation, D=the surface-working member width (for example, roller drum width), P=the quantity of paths 108 in the plurality of paths 108.

Block 316 includes generating the edge-to-edge compaction plan 107 based on results of blocks 302-314. The edge-to-edge compaction plan 107 comprises the plurality of paths 108. In the example of FIGS. 4-6, the plurality of paths 108 comprise boundary path 109*a* (see FIG. 4) that includes a center-line-of-travel C, boundary path 109*b* that includes a center-line-of-travel C (See FIG. 4), internal path 111*a* (see FIGS. 5 and 6) that includes a center-line-of-travel C (for clarity, shown on FIG. 4), and internal path 111*b* (see FIG. 6) that includes a center-line-of-travel C (for clarity shown on FIG. 4) across the worksite surface 102. As shown in FIG. 5, internal path 111*a* includes an overlap-section 142*a* that overlaps the boundary path 109*a* and another overlap-section 142*a* that overlaps boundary path 109*b*. As can be seen, the width of the respective overlap-sections 142*a* vary along the length of the internal path 111*a* as the compaction machine 100*a* traverses the such internal path 111*a*.

Turning now to FIG. 6, the other internal path 111*b* also includes an overlap-section 142*b* that overlaps a portion of internal path 111*a*, a portion of boundary path 109*a* and a portion of boundary path 109*b*. The width of the overlap-section 142*b* varies along the length of internal path 111*b* as the machine traverses internal path 111*b*. The overlap-section 142*b* includes a multi-overlap portion 144*a* that overlaps a portion of overlap-section 142*a* (compare to FIG. 5) and a multi-overlap portion 144*b* that overlaps a portion of overlap-section 142*a*. Multi-overlap portions 144*a*, 144*b* occur when there is more than one overlap-section 142 on a given portion of the worksite surface 102. Such multi-overlap may be double or more overlapping of compaction. Block 316 may further include displaying on the user interface 122 the edge-to-edge work plan 107 (in this case the edge-to-edge compaction plan 107).

Block 318 includes activating, by the controller 130, the compaction machine 100*a* to traverse the center-line-of travel C of each of the plurality of paths 108 of the edge-to-edge compaction plan, wherein the compaction machine 100*a* traverses the worksite surface 102 according to the edge-to-edge compaction plan.

Figure 7:
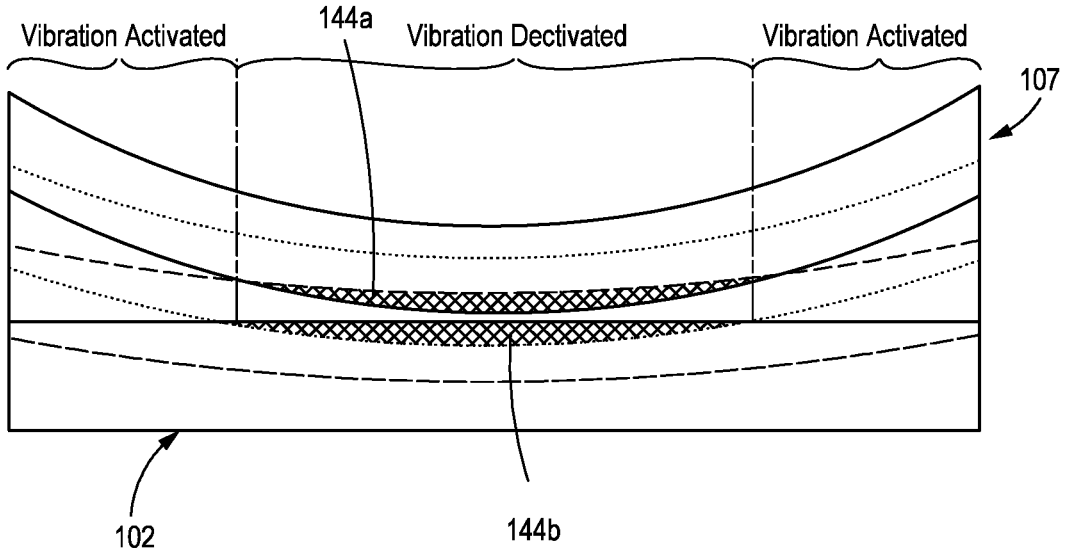
FIG. 7 is a schematic illustration of multi-overlap portions on a worksite surface in relation to activation/deactivation of vibrations of vibratory mechanism.

Turning now to FIG. 7, block 320 includes selectively deactivating, by the controller 130, vibration of the roller drum 106 such that when the roller drum 106 is disposed on the multi-overlap portion 144*a*, 144*b* vibration of the roller drum 106 is in a deactivated state, and (re) activating, by the controller 130, vibration of the roller drum 106 such that vibration of the roller drum 106 is in an activated state when the roller drum 106 is disposed outside a multi-overlap portion 144*a*, 144*b*. For the exemplary embodiment of FIG. 7, when the compaction machine traverses internal path 111*b*, subsequent to traversal of boundary paths 109*a*, 109*b* and internal path 111*a*, multiple-overlap portions 144*a*, 144*b* occur. The controller 130 will still traverse the entirety of internal path 111*b* but when the roller drum 106 is disposed on the multi-overlap portion 144*a*, 144*b*, the vibratory mechanism 110, 112 will be deactivated and when the roller drum 106 is disposed outside the multi-overlap portions 114*a*, 144*b* the vibratory mechanism 110, 112 will be in an activated state. Alternatively, in some embodiments, the controller 130 may ramp vibration of the roller drum 106 down/up before the compaction machine 100*a* enters/leaves the multi-overlap portions 144*a*, 144*b* for a more gradual transition from vibrations/vibration-activated to no vibration (vibration-free/vibration-deactivated) or from no vibration (vibration-free/vibration deactivated) to vibration/vibration activated. Block 320 may further include displaying on the user interface 122 the one or more overlap section(s) 142 and/or one or more multi-overlap portion(s) 144 of the edge-to edge compaction plan, as well as displaying information indicative of where vibration is deactivated (e.g. in a multi-overlap portion 144) and/or where vibration is activated in the displayed edge-to-edge compaction plan 107 or portion of the displayed edge-to-edge compaction plan 107.

In general, the foregoing disclosure finds utility in various applications relating to control of construction machines 100 and compaction machines 100*a*. More specifically, the disclosed control system 200 and method may be used to plan, generate and activate execution of an edge-to-edge work plan 107 (e.g., compaction plan) that allows for the paths 108 of the construction machine 100 (e.g., compaction machine 100*a*) to substantially cover or completely cover the worksite surface 102 to be worked (e.g., compacted) and to avoid over-working (over compaction) of certain portions of the worksite surface 102. The generated edge-to-edge work plan 107 for the worksite surface 102 allow for each path 108 to have different overlap amounts (if needed) on adjacent paths 108 and for such overlap distance to vary (not be a fixed overlap distance) along each path 108, as needed. Moreover, over working (e.g., compaction) of multi-overlap portions 144 may be avoided by deactivating the vibratory mechanisms 110, 112 of the surface-working member 106 (roller drum 106) so that vibration of the surface-working member 106 (roller drum 106) is deactivated when the surface-working member 106 (roller drum 106) is disposed on the multi-overlap portions 144, and then reactivating the vibration of the surface-working member 106 (roller drum 106) so that vibration of the surface-working member 106 (roller drum 106) is activated when the surface-working member 106 (roller drum 106) is outside of the multi-overlap portions 144.

From the foregoing, it will be appreciated that while only certain embodiments have been set forth for the purposes of illustration, alternatives and modifications will be apparent from the above description to those skilled in the art. These and other alternatives are considered equivalents and within the spirit and scope of this disclosure and the appended claims.

What is claimed is:

1. A control system for a construction machine that includes a surface-working member configured to work a worksite surface as the construction machine traverses the worksite surface, the worksite surface including a perimeter that includes a plurality of boundary sides, the control system comprising:

a controller configured to:

receive work parameters associated with working of the worksite surface by the surface-working member, the work parameters including a surface-working member width, a minimum overlap distance, and a maximum overlap distance;

generate an edge-to-edge work plan of the worksite surface, the edge-to-edge work plan including a plurality of paths each having a center-line-of-travel, wherein one of the plurality of paths includes a first outer edge defined by a first boundary side and another of the plurality of paths includes a second outer edge defined by a second boundary side, the plurality of paths including:

a first path that includes a first center-line-of-travel, and a second path that includes a second center-line-of-travel and a second path overlap-section that overlaps the first path, wherein the second path overlap-section has a width that varies along a length of the second path; and activate the construction machine to traverse the center-line-of travel of each of the plurality of paths.

2. The control system of claim 1, in which the controller is further configured to:

determine a travel direction orientation across the worksite surface based on a boundary side of the perimeter or a slope of the worksite surface or a user input received from a user interface in communication with the controller.

3. The control system of claim 2, in which the controller is further configured to:

determine a maximum width of the worksite surface, the maximum width oriented in a direction transverse to the travel direction orientation, and determine a quantity of paths in the plurality of paths based on the maximum width, the surface-working member width, and the minimum overlap distance.

4. The control system of claim 3, wherein the plurality of paths further includes:

a third path that includes a third center-line-of-travel and a third path overlap-section that overlaps the second path, wherein the third path overlap-section includes a multi-overlap portion that overlaps the second path overlap-section, and wherein of the third path overlap-section has a width that varies along a length of the third path.

5. The control system of claim 4, wherein the one of the plurality of paths that includes the first outer edge defined by the first boundary side is a first boundary path and the other of the plurality of paths that includes the second outer edge defined by the second boundary side is a second boundary path, wherein the center-line-of-travel for the first boundary path is disposed half of the surface-working member width from first boundary and the center-line-of-travel for the second boundary path is disposed half of the surface-working member width from second boundary, wherein each of the plurality of paths disposed between the first boundary path and the second boundary path are internal paths, and in which the controller is further configured to:

determine a location of each center-line-of-travel of each of the internal paths, wherein the location of center-level-of travel of contiguous internal paths, of the internal paths, are offset by a distance S, wherein S is equal to $((W-D)/(P-1))$, wherein W is equal to a width of the worksite surface, the width transverse to the travel direction orientation, D is the surface-working member width, and P is equal the quantity of paths.

6. The control system of claim 5, wherein the construction machine is a compaction machine and the surface-working member is a roller drum configured to compact the worksite surface, wherein the work parameters are compaction parameters associated with compaction of the worksite surface, wherein the surface-working member width is a width of the roller drum, wherein the compaction parameters further includes at least one of:

a vibration amplitude of the roller drum, or a maximum vibration amplitude of the roller drum, wherein the edge-to-edge work plan is an edge-to-edge compaction plan, and in which the controller is further configured to:

selectively deactivate vibration of the roller drum when the roller drum is disposed on the multi-overlap portion.

7. The control system of claim 6, in which the controller is further configured to:

gradually decrease the vibration of the roller drum to no vibration before entering the multi-overlap portion, or gradually increase the vibration of the roller drum before exiting the multi-overlap portion.

8. A method of controlling a construction machine that includes a surface-working member configured to work a worksite surface as the construction machine traverses the worksite surface, the worksite surface including a perimeter that includes a plurality of boundary sides, the method comprising:

receiving, by a controller in operable communication with the construction machine, work parameters associated with working of the worksite surface by the surface-working member, the work parameters including a surface-working member width, a minimum overlap distance, and a maximum overlap distance;

generating, by the controller, an edge-to-edge work plan of the worksite surface, the edge-to-edge work plan including a plurality of paths each having a center-line-of travel, wherein one of the plurality of paths includes a first outer edge defined by a first boundary side and another of the plurality of paths includes a second outer edge defined by a second boundary side, the plurality of paths including:

a first path that includes a first center-line-of-travel, and a second path that includes a second center-line-of-travel and a second path overlap-section that overlaps the first path, wherein the second path overlap-section has a width that varies along a length of the second path; and activating, by the controller, the construction machine to traverse the center-line-of travel of each of the plurality of paths.

9. The method of claim 8, further comprising:

determining, a travel direction orientation across the worksite surface based on one of:

a length of the boundary sides of the perimeter, a slope of the worksite surface, or a user input received from a user interface; and determining a maximum width of the worksite surface, the maximum width oriented in a direction transverse to the travel direction orientation.

10. The method of claim 9, further comprising:

determining a quantity of paths based on the maximum width, the surface-working member width, and the minimum overlap distance.

11. The method of claim 10, wherein the plurality of paths further includes a third path that includes a third center-line-of-travel and a third path overlap-section that overlaps the second path, wherein the third path overlap-section includes a multi-overlap portion that overlaps the second path overlap section, and wherein the third path overlap-section has a width that varies along a length of the third path, wherein the one of the plurality of paths that includes the first outer edge defined by the first boundary side is a first boundary path and the other of the plurality of paths that includes the second outer edge defined by the second boundary side is a second boundary path, wherein the first center-line-of-travel for the first boundary path is disposed half of the surface-working member width from first boundary and the second center-line-of- travel for the second boundary path is disposed half of the surface-working member width from second boundary, wherein the plurality of paths disposed between the first boundary path and the second boundary path are internal paths, and in which the method further comprises:

determining a location of each center-line-of-travel of each of the internal paths, wherein the location of the center-line-of-travel of contiguous internal paths, of the internal paths, are offset by a distance S, wherein S is equal to ((W−D)/(P−1)), wherein W is a width of the worksite surface, the width transverse to the travel direction orientation, D is the surface-working member width, and P is the quantity of paths in the plurality of paths.

12. The method according to claim 11, wherein the construction machine is a compaction machine the surface-working member is a roller drum configured to compact the worksite surface, wherein the work parameters are compaction parameters associated with compaction of the worksite surface, wherein the surface-working member width is a width of the roller drum, wherein the compaction parameters further includes at least one of:

a vibration amplitude of the roller drum, or a maximum vibration amplitude of the roller drum, wherein the edge-to-edge work plan is-an edge-to-edge compaction plan, and the method further comprising:

selectively deactivating vibration of the roller drum when the roller drum is disposed on the multi-overlap portion.

13. The method according to claim 12 further comprising:

gradually decreasing the vibration of the roller drum to no vibration before entering the multi-overlap portion; or gradually increasing the vibration of the roller drum before exiting the multi-overlap portion.

14. A control system for a compaction machine that includes a roller drum rotationally coupled to the compaction machine and configured to compact a worksite surface as the compaction machine traverses the worksite surface, the roller drum further configured to apply vibrational forces to the worksite surface, the worksite surface including a perimeter that includes a plurality of boundary sides, the plurality of boundary sides including a first boundary side, a second boundary side and remaining boundary sides, the control system comprising:

a controller, configured to:

receive compaction parameters associated with compaction of the worksite surface, the compaction parameters including at least one of a roller drum width, a minimum overlap distance, a maximum overlap distance, a vibration of the roller drum, or a maximum vibration amplitude of the roller drum;

generate an edge-to-edge compaction plan of the worksite surface, the edge-to-edge compaction plan including a plurality of paths each having a center-line-of-travel, wherein one of the plurality of paths includes a first outer edge defined by a first boundary side and another of the plurality of paths includes a second outer edge defined by a second boundary side, the plurality of paths including:

a first path that includes a first center-line-of-travel, and a second path that includes a second center-line-of-travel and a second path overlap-section that overlaps the first path, wherein the second path overlap-section has a width that varies along a length of the second path;

activate the compaction machine to traverse the center-line-of travel of the plurality of paths; and selectively deactivate vibration of the roller drum when the roller drum is disposed on a multi-overlap portion that overlaps with the second path overlap-section.

15. The control system of claim 14, in which the controller is further configured to:

determine, when the first boundary side is longer than or equal to the second boundary side and the first boundary side is longer than each of the remaining boundary sides, a travel direction orientation across the worksite surface based on the first boundary side.

16. The control system of claim 15, in which the controller is further configured to:

determine a maximum width of the worksite surface based on the travel direction orientation.

17. The control system of claim 16, in which the controller is further configured to:

determine a quantity of paths based on the maximum width, the roller drum width, and the minimum overlap distance.

18. The control system of claim 17, wherein the one of the plurality of paths that includes the first outer edge defined by the first boundary side is a first boundary path and the other of the plurality of paths that includes the second outer edge defined by the second boundary side is a second boundary path, wherein the first center-line-of-travel for the first boundary path is disposed half of the roller drum width from first boundary and the second center-line-of-travel for the second boundary path is disposed half of the roller drum width from second boundary, wherein each of the plurality of paths disposed between the first boundary path and the second boundary path are internal paths, and in which the controller is further configured to;

determine a location of each center-line-of-travel of each of the internal paths, wherein the location of the center-line-of travel of contiguous internal paths, of the internal paths, are offset by a distance S, wherein S equals ((W−D)/(P−1)), wherein W equals a width of the worksite surface, the width transverse to the travel direction orientation, D is the roller drum width and P is the quantity of paths in the plurality of paths.

19. The control system of claim 18, in which the controller is further configured to:

gradually decrease to no vibration the vibration of the roller drum before entering the multi-overlap portion.

20. The control system of claim 19, in which the controller is further configured to:

determine the quantity of paths according to a formula of $P=(W_{max}-L)/(D-L)$, wherein P is rounded up to a nearest whole number, $W_{max}$ is the maximum width of the worksite surface, L is the minimum overlap, and D is the roller drum width.

* * * * *